US005743354A

United States Patent [19]

Hunter

[11] Patent Number: 5,743,354

[45] Date of Patent: Apr. 28, 1998

[54] OFFSHORE PLATFORM ACCESS ROPE

[76] Inventor: Valentino H. Hunter, P.O. Box 502, Rockport, Tex. 78381

[21] Appl. No.: 666,240

[22] Filed: Jun. 20, 1996

[51] Int. Cl.[6] ..... E06C 9/14; E06C 9/00

[52] U.S. Cl. ..... 182/100; 182/190; 182/196; 405/195.1

[58] Field of Search ..... 405/195.1, 224; 182/100, 190, 196

[56] References Cited

U.S. PATENT DOCUMENTS 3,642,277 2/1972 Gersten .
3,754,758 8/1973 Hanson ..... 182/100
4,405,034 9/1983 Dunne .
4,557,442 12/1985 Krezak .
4,601,253 7/1986 Anders .
4,789,045 12/1988 Pugh .
5,105,909 4/1992 Leonards .

*Primary Examiner*—Tamara L. Graysay
*Assistant Examiner*—Gary S. Hartmann
*Attorney, Agent, or Firm*—G. Turner Moller

[57] ABSTRACT

An access rope for an offshore production platform comprises an upper end attached to a chain fixed to the platform, a central stabilizing section providing a series of weights and a lower section providing hand holding implements. The weights are of different size and act so the rope swings less in response to the wind than conventional ropes. The hand holding implements include a loop in the rope which can be grasped by a user and a series of enlarged knots. The hand holding section of the main rope is helically wrapped with a smaller rope in which the adjacent wraps are spaced well apart.

20 Claims, 1 Drawing Sheet

OFFSHORE PLATFORM ACCESS ROPE

This invention is an access rope for an offshore production platform from which oil and gas wells are produced.

BACKGROUND OF THE INVENTION

One of the many problems with producing wells offshore is in gaining access to the production platform from which the wells extend into the earth. Of necessity, production platforms are well above sea level to avoid damage from waves. Production platforms are usually unattended so workers and equipment must have the ability to transfer unaided from the transport vehicle to the platform. If the workers are fortunate enough to ride in a helicopter, this is obviously not a problem. More commonly, men and equipment are taken to the production platform by a work boat or crew boat.

In this high tech age, the standard technique for a man to get from a crew boat to the platform is, using a boat hook, to snag an access rope hanging from the platform. The man pulls the rope over to the boat, grabs onto the rope and swings onto a small ledge about "boat high" on the platform. The man then climbs stairs leading up to the platform. In some cases, the worker must take any needed tools with him. More often, once the man is on the platform, a crane or other lifting implement is used to lift tools or equipment from the boat onto the platform. One can imagine there are many calamities and many near calamities, particularly when the sea is rough, the weather cold and the wind high.

Standard access ropes are rather simple arrangements and comprise a thimble attached by a shackle to a chain more-or-less permanently affixed to the platform. A rope is spliced onto the thimble and hangs down to within a few feet of the water line. The length of standard access ropes varies depending on the size and design of the platform and is normally in the range of 45–85' long. Disclosures of some interest relative to this invention are found in U.S. Pat. Nos. 3,642,277; 4,405,034; 4,557,442; 4,601,253; 4,789,045 and 5,105,909.

There are a variety of problems with standard access ropes. The ropes are often wet from spray caused by waves striking the platform and are thus slippery and hard to hold onto. The standard access rope sometimes becomes entangled in the platform, such as being wrapped around railings or the like, and cannot be retrieved with a boat hook. If the crew cannot retrieve the access rope, the platform is inaccessible. In this situation, the crew boat has to return to port and a helicopter transports men and equipment to the platform. This is an expensive proposition, costing a round trip for the boat and men, a helicopter trip and any lost production or damages caused by the delay in workers reaching the platform. The exact cost of the crew boat and men depends, of course, on how far the platform is from port, the number of men involved and the equipment being taken to the platform. It would not be surprising for a round trip to take ten hours and cost a few thousand dollars. Helicopter trips are usually in the neighborhood of $500–800/hour from the time the helicopter takes off until it returns. These costs, of course, can be small compared to lost production or damage occurred by delay in reaching the platform. Sometimes, a trip to a production platform is a routinely scheduled affair but often a trip is made in response to a sensor on the platform signalling that something is amiss. It will be seen that reliable, inexpensive and safe access to production platforms is quite desirable.

SUMMARY OF THE INVENTION

In this invention, it is recognized that improvements can be made in the access rope to minimize the problems associated with standard access ropes. Specifically, better hand holds can be provided and it is possible to reduce swinging of the access rope caused by wind. It will be seen that a reduction in the swinging of the access rope will reduce or minimize the access rope from becoming entangled with the platform so the rope can always be retrieved with a boat hook.

In this invention, a series of weights are attached to the rope to act as stabilizers against wind induced movement. Without being bound by any particular theory, it appears that using weights of different mass spaced along the rope prevents the rope from swinging at a resonant frequency thereby reducing swinging of the rope. One system that works exceptionally well is a central large weight between two smaller weights. The center weight appears to be more stationary and the smaller weights tend to oscillate relative to the central weight. The overall movement of the rope due to wind induced forces is much smaller than for a standard access rope.

Below the stabilizer weights is a series of improved hand holds. A loop is spliced into the rope. Below the loop are a series of knots covered with a tough plastic coating. Between the knots a separate line is spirally wrapped around the main rope. This allows the workman to hang on to the loop with one hand and clutch the remainder of the rope with the other hand.

It is object of this invention to provide an improved rope providing access to an offshore platform.

Another object of this invention is to provide an offshore platform access rope stabilized against wind induced movement.

A further object of this invention is to provide an access rope having improved hand holding implements.

These and other objects and advantages of this description will become more apparent as this description proceeds, reference being made to the accompanying drawings and appended claims.

DETAILED DESCRIPTION

Figures 1, 2:
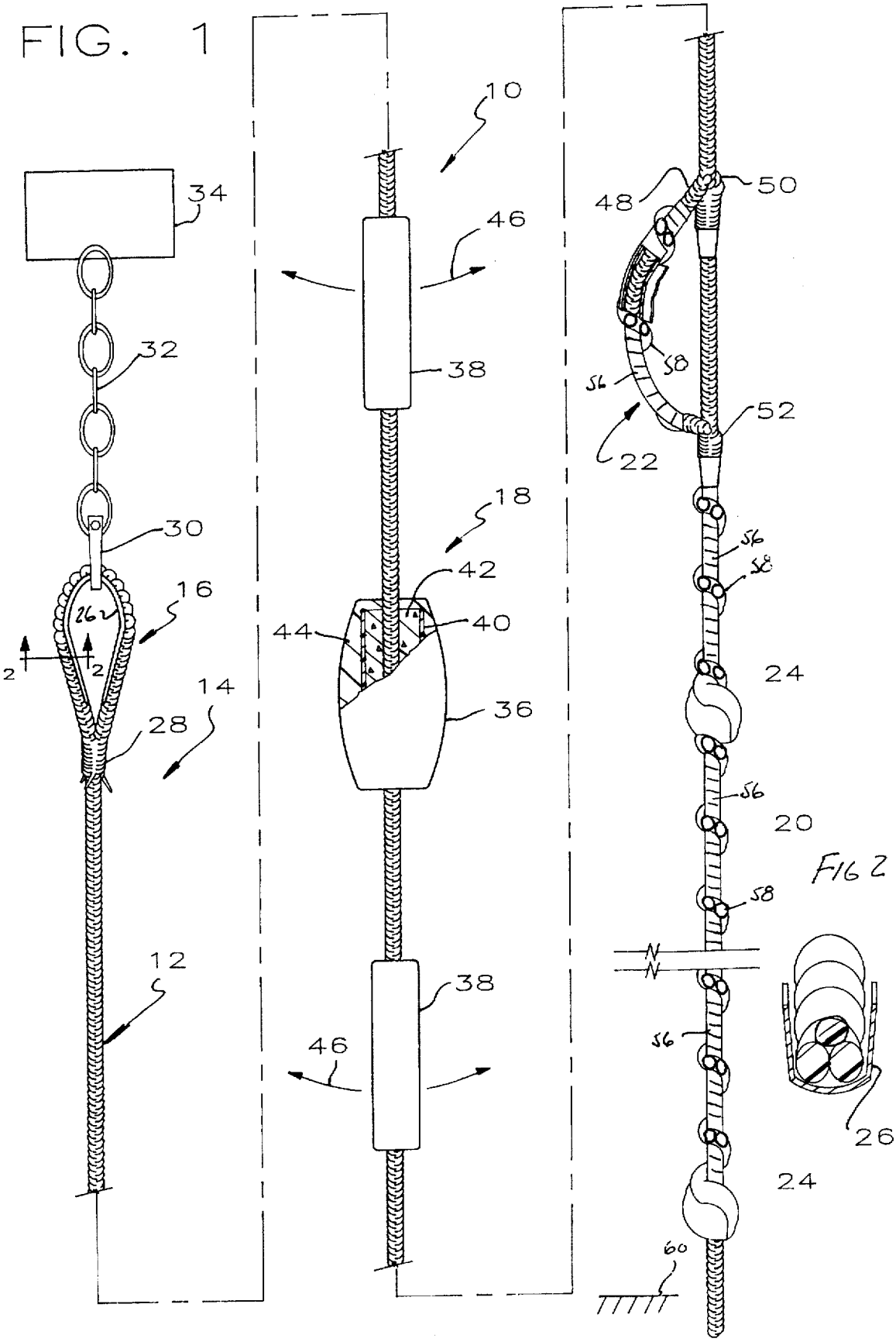
FIG. 1 is a side elevational view of an access rope of this invention.
FIG. 2 is an enlarged cross-sectional view of the access rope of FIG. 1, taken substantially along line 2—2 thereof as viewed in the direction indicated by the arrows.

Referring to FIG. 1, an access rope 10 of this invention comprises a main load bearing rope 12 having an upper end 14 having means 16 for attachment to an offshore production platform, a central wind stabilizing section 18 and a lower end 20 providing a series of hand holding implements 22, 24. The main rope 12 extends from the upper end 12 of the access rope 10 to the lower end and is unspliced, i.e. the main load is transmitted through the fibers and strands of a single main rope 12. The main rope 12 may be of any suitable type, such as a three strand ¾" Polydac having a tensile strength of 9,000 pounds. Polydac is a known marine rope available from Tubbs Rope Works of Tucson, Ariz. The outside cover of this rope is made from a mixture of polyester and Polypro yarns. The center of the rope is made from a yard which is all Polypro. An outstanding characteristics of this rope is that it does not stretch. The main rope 12 is coated with a pigmented polyurethane to retard deterioration from sunlight.

The upper end 14 of the access rope 10 may be of conventional configuration and is illustrated as comprising a stainless steel thimble 26 connected to the end of the main rope 12. The thimble 26 is of U-shaped cross-section and is of a conventional shape, such as oval, teardrop or horse collar. The upper end of the main rope 12 is wrapped around the thimble 26 and extends in the U of the thimble 26, as shown in FIG. 2. The free end of the main rope 12 is spliced into the main rope 12 at a location 28.

The thimble 26 hangs on a conventional shackle 30 supported by a chain 32 affixed to the production platform 34 in any suitable manner. Thus, the thimble 26 operates in a conventional manner to suspend the main rope 12 from the shackle 30 so the frictional wear between the shackle 30 and the thimble 26 is absorbed by the metal thimble 26 rather than the fibrous rope 12. The thimble 26 also operates to create an acceptable curvature of the main rope 12, as opposed to a kink which wears rapidly.

The central wind stabilizing section 18 includes a plurality of weights 36, 38 spaced along the main rope 12. Without being bound by any particular theory, it appears that using weights of different mass spaced along the main rope 12 prevents the access rope 10 from swinging at a resonant frequency thereby reducing swinging. Thus, the weights 36, 38 are preferably of different mass. The explanation may be substantially simpler, i.e. that the mass of the weights 36, 38 is great enough that wind induced forces are simply too small to substantially affect the weights 36, 38. Thus, it is preferred that the weights should aggregate at least eight pounds and preferably at least twelve pounds. By using cement as a filler for the weights 36, 38, the density is quite high so the size of the weights 36, 38 is rather small thereby providing a small surface area for the wind to work on. In this regard, it is preferred that the specific gravity of the weights 36, 38 be on the order of at least 1.3.

One system that works exceptionally well is where the weight 36 is more massive, and spaced between, the weights 38. In this embodiment, the mass of the central weight 36 is preferably at least twice the mass of the weights 38. In a preferred embodiment, the central weight 36 weighs 8 pounds and the end weights 38 weigh 3 pounds each. The weights 36, 38 are positioned in a suitable location below the upper rope section 14. Typically, the weights 36, 38 are located in the central one-third of the main rope 12. The weights 36, 38 are spaced a suitable distance apart, usually 3–6'. The weights 36, 38 may be made in any suitable manner. One successful approach for the smaller weights 38 is to place a 1½" PVC sleeve around the main rope 12 and fill the annulus between the main rope 12 and the sleeve with cement. The sleeve is wrapped with a rubber mat and sealed with duct tape and then covered with a liquid plastic dip that sets up into a tough flexible coating.

The same approach may be seen in the large weight 36 where a 4" PVC sleeve 40 surrounds the main rope 12 and the annulus is filled with cement 42. The sleeve 40 is wrapped with a rubber mat, sealed with duct tape and then covered with a liquid plastic dip that sets up into a tough flexible coating 44. The liquid plastic may be of any suitable type, such as Plastidip made by PDI, Inc. of Circle Pines, Minn.

The lower end 20 of the access rope 10 includes a secondary rope 48 which may be ⅝" Polydac which is a known rope available from Tubbs Rope Works of Tucson, Ariz. The rope 48 provides an upper end 50 spliced into the main rope 12 and a lower end 52 spliced into the main rope 12 providing the hand hold or loop 22 at a location substantially below the lowermost weight 38 so a user holding onto the loop 22 is not struck by the lowermost weight 38. Thus, the loop 22 is at least half an adult body length, or about three feet, and preferably six feet below the lowermost weight 38. When the access rope 10 is installed, the loop 22 is about head high to an adult so the worker can easily hang onto it. The secondary rope 48 extends inside a flexible hose or tube 54 which acts to hold the loop 22 open, i.e. the loop 22 is prevented from collapsing as a simple rope loop would collapse. Thus, the loop 22 may be easily grasped.

A cord 56 is wrapped around the hose 54 and a half hitch knot 58 is tied at each revolution around the hose 54. This creates a helically wound series of half hitch knots 58 around the hose 54 with adjacent wraps of the knots being spaced apart two or three diameters of the hose 54. The cord 56 may be of any suitable type, such as ¼" braided Polytresse available from The Lehigh Group of Allentown, Penn. The cord 56 and knots 58 are then coated with a liquid plastic dip, such as Plastidip from PDI, Inc. of Circle Pines, Minn. to provide a tough flexible coating.

The main rope 12 is knotted into a series of suitable knots providing the hand holding implements 24. The rope section below the loop 22 is also wrapped with the cord 56 and a half hitch knot 58 is tied at each revolution around the main rope 12. This creates a helically wound series of half hitch knots 58 around the main rope 12 with adjacent wraps of the half hitch knots 58 being spaced apart at least two or three diameters of the main rope 12. This provides a rough surface which is easily grasped. The area between the knots 24 is conveniently coated with a liquid plastic that sets into a tough flexible coating. This material is known as Plastidip and is available from PDI, Inc. of Circle Pines, Minn. This provides a rough surface which is easily grasped. Although the number of knots 24 may vary, three has proved to be suitable. The knots 24 are spaced apart a suitable distance, such as 18".

The overall length of the access rope 10 is similar to that of standard access ropes and the exact length depends on the size and design of the production platform 32. Typically, the access rope is 45–85' long.

In use, access rope 10 is hung from the chain 32 at a conventional location where standard access ropes are hung. When the wind blows, the center weight 36 appears to be more stationary while the smaller weights 38 tend to oscillate, in the direction shown by the arrows 46, relative to the central weight 36. For whatever reasons, the overall swinging movement of the access rope 10 due to wind induced forces is much smaller than for a standard access rope. Thus, the access rope 10 is much less susceptible to becoming entangled in the platform 32. Thus, the access rope 10 is much more likely to be retrievable by a boat hook so workers can gain access to the production platform.

When the worker snags the access rope 10 with a boat hook, the rope 10 is pulled toward the crew boat. The worker grasps the loop 22 and/or the knots 24 in a comfortable manner and swings onto the landing ledge 60 on the platform 32 in a conventional manner.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. Access for an offshore platform comprising a rope having an upper end providing means for connection to the platform; a lower end providing a series of hand holding implements; and a central section, between the upper and lower sections, providing means for stabilizing the rope against wind induced movement comprising a series of weights spaced along the rope, an uppermost of the hand holding implement being at least about three feet below a lowermost of the weights.

2. The access of claim 1 wherein the connection means comprises a thimble of U-shaped cross-section, the rope extending around the thimble and being disposed in the U.

3. The access of claim 1 wherein the lower end provides a series of spaced apart knots in the rope and a loop, the knots and the loop being the hand holding implements and further comprising a cord, smaller than the first mentioned rope, being wound around the first mentioned rope and having a half hitch knot tied on successive revolutions of the cord.

4. The access of claim 1 wherein the lower end provides a series of spaced apart knots in the rope and a loop, the knots and the loop being the hand holding implements and wherein the main rope and the cord, between the knots, are covered with a plastic coating.

5. The access of claim 1 wherein the lower end provides a series of spaced apart knots in the rope and a loop, wherein the loop comprises a tubular hose and a secondary rope, inside the hose, spliced into the first mentioned rope at spaced locations along the first rope, the tubular hose acting to hold the loop open.

6. The access of claim 5 further comprising a cord, smaller than the first mentioned rope, being wound around the hose and having a half hitch knot tied on successive revolutions of the cord.

7. The access of claim 1 wherein the series of weights comprises first and second weights of different mass.

8. The access of claim 1 wherein at least some of the weights comprise a tube around the rope, a body of cement between the tube and the rope, and a plastic coating covering the body of cement and the tube.

9. Access for an offshore platform comprising a rope having an upper end providing means for connection to the platform; a lower end providing a series of hand holding implements; and a central section, between the upper and lower sections, providing means for stabilizing the rose against wind induced movement comprising a series of weights spaced alone the rope, the series of weights comprises a first weight of a first predetermined mass and a pair of second weights, of smaller mass than the first mass, on opposite sides of the first weight.

10. The access of claim 9 wherein the series of weights aggregate at least eight pounds.

11. The access of claim 9 wherein the series of weights aggregate at least twelve pounds.

12. An offshore production platform for petroleum wells comprising an access rope including a main rope having an upper end connected to the platform; a lower end providing a series of hand holding implements; and a central section, between the upper and lower sections, providing means for stabilizing the rope against wind induced movement comprising a series of weights spaced along the rope, an uppermost of the hand holding implements being at least about three feet below a lowermost of the weights.

13. The offshore production platform of claim 12 wherein the lower end provides a series of spaced apart knots in the rope, the knots being the hand holding implements and further comprising a cord, smaller than the rope, being wound around the and having a half hitch knot tied on successive revolutions of the cord.

14. The offshore production platform of claim 12 wherein the lower end provides a series of spaced apart knots in the rope, the knots being the hand holding implements and wherein the rope and the cord, between the knots, are covered with a plastic coating.

15. The offshore production platform of claim 13 wherein the lower end provides a series of spaced apart knots in the rope and a loop, wherein the loop comprises a tubular hose and a secondary rope, inside the hose, spliced into the first mentioned rope at spaced locations along the first rope, the tubular hose being covered with a plastic coating.

16. The production platform of claim 15 further comprising a cord, smaller than the first mentioned rope, being wound around the hose and having a half hitch knot tied on successive revolutions of the cord.

17. The offshore production platform of claim 12 wherein the series of weights comprises first and second weights of different mass.

18. The offshore production platform of claim 12 wherein the series of weights comprises a first weight of a first predetermined mass and a pair of second weights, of smaller mass than the first mass, on opposite sides of the first weight.

19. The offshore production platform of claim 12 wherein the series of weights aggregate at least eight pounds.

20. The offshore production platform of claim 12 wherein at least some of the weights comprise a tube around the rope, a body of cement between the tube and the rope, and a plastic coating covering the body of cement and the tube.

* * * * *